US007565758B2

(12) United States Patent
Poiré

(10) Patent No.: US 7,565,758 B2
(45) Date of Patent: Jul. 28, 2009

(54) QUICK ATTACH COUPLING DEVICE

(76) Inventor: Denis Poiré, 6 rue de Monaco, Victoriaville, Québec (CA) G6P 6R9

( * ) Notice: Subject to any disclaimer, the term of this patent is extended or adjusted under 35 U.S.C. 154(b) by 74 days.

(21) Appl. No.: 11/433,964

(22) Filed: May 15, 2006

(65) Prior Publication Data

US 2006/0254096 A1 Nov. 16, 2006

(30) Foreign Application Priority Data

May 16, 2005 (CA) ..... 2507393

(51) Int. Cl.
*E02F 3/96* (2006.01)

(52) U.S. Cl. ..... 37/468; 37/403; 37/406; 414/723

(58) Field of Classification Search ..... 37/468, 37/403, 903; 414/722, 724, 694, 718, 723
See application file for complete search history.

(56) References Cited

U.S. PATENT DOCUMENTS 3,148,789 A * 9/1964 Gourjon ..... 414/694
3,251,491 A * 5/1966 French et al. ..... 414/694
3,412,880 A * 11/1968 Tweedale ..... 414/694
3,465,904 A * 9/1969 Pensa ..... 414/694
3,586,113 A * 6/1971 Grant ..... 173/34
3,923,172 A * 12/1975 Jankowiak ..... 414/718
3,977,148 A * 8/1976 Ranini ..... 52/848
4,029,225 A * 6/1977 Wirt ..... 414/694
4,405,281 A * 9/1983 Ruttershoff ..... 414/722
4,571,146 A * 2/1986 Eriksson ..... 414/687
4,666,049 A * 5/1987 Gilmore, Jr. ..... 212/175
4,693,384 A * 9/1987 Gilmore, Jr. ..... 212/257
4,798,511 A * 1/1989 Kaczmarczyk et al. ..... 414/686
4,887,939 A * 12/1989 Langenfeld et al. ..... 414/722
5,015,147 A * 5/1991 Taylor et al. ..... 414/685
5,040,615 A * 8/1991 Fletcher ..... 172/47
5,098,252 A * 3/1992 Sheesley et al. ..... 414/723
5,108,252 A * 4/1992 Gilmore et al. ..... 414/694
5,171,124 A * 12/1992 Foster ..... 414/685
5,199,844 A * 4/1993 Gilmore et al. ..... 414/694
5,360,313 A * 11/1994 Gilmore et al. ..... 414/694
5,484,250 A * 1/1996 Gilmore et al. ..... 414/723
5,494,395 A * 2/1996 Raunisto ..... 414/694

(Continued)

FOREIGN PATENT DOCUMENTS

JP 09078621 A * 9/1997

(Continued)

*Primary Examiner*—Thomas A Beach
(74) *Attorney, Agent, or Firm*—Eric Fincham

(57) ABSTRACT

An assembly for securing an implement to a boom, the assembly comprising a link member pivotally connected to a boom and, a first recess being formed in a first of the arm and a second being formed in the link member proximate one end thereof, the second recess having elongated configuration with a longitudinal axis extending parallel to the link member longitudinal axis, the implement assembly comprising a mounting arm and a implement, the mounting arm having a pair of first pins extending outwardly from opposite sides thereof and a pair of second pins extending outwardly from opposite sides, the first pair of pins being located between the implement receiving end and the center of gravity of the implement assembly. The arrangement permits rapid and secure switching of different implements.

8 Claims, 5 Drawing Sheets

U.S. PATENT DOCUMENTS 5,556,217 A * 9/1996 Deyo et al. ..... 403/61
5,611,656 A * 3/1997 Davis et al. ..... 414/694
5,983,535 A * 11/1999 Kaczmarski et al. ..... 37/468
6,076,855 A * 6/2000 Webb ..... 280/765.1
6,158,949 A * 12/2000 Walth et al. ..... 414/722
6,301,811 B1 * 10/2001 Gilmore, Jr. ..... 37/468
6,428,265 B1 * 8/2002 Gilmore, Jr. ..... 414/723
6,499,934 B1 * 12/2002 Kaczmarski et al. ..... 414/723
6,725,584 B2 * 4/2004 Inoue et al. ..... 37/468
7,070,383 B2 * 7/2006 Sugimoto ..... 414/694
7,147,425 B2 * 12/2006 Holt ..... 414/694
7,165,930 B2 * 1/2007 Pisco ..... 414/729
2002/0187034 A1 * 12/2002 Gilmore, Jr. ..... 414/723
2005/0220601 A1 * 10/2005 Pisco ..... 414/723

FOREIGN PATENT DOCUMENTS

JP 11036768 A * 2/1999

* cited by examiner

QUICK ATTACH COUPLING DEVICE

FIELD OF THE INVENTION

The present invention relates to a quick attach coupling device and more particularly, relates to a quick attach coupling device suitable for use with heavy equipment.

BACKGROUND OF THE INVENTION

Heavy equipment is typically used in various types of demolition and construction and loading; such equipment can include tractors, backhoes, excavators, loaders, and the like. Often, the heavy equipment is designed to be employed with different types of implements.

Typically, the piece of heavy equipment will include a boom extending from a portion thereof, the boom having a distal end at which end an arm is attached. The arm pivots relative to the boom and the distal end of the arm is normally designed to be secured to an implement. The implement can be any which is utilized such as a shovel, a bucket, grapples, magnets, etc. Normally, hydraulic cylinders are utilized for raising and lowering the boom and for moving the implement relative to the arm.

To most operators of such heavy equipment, it is most desirable that various implements be conveniently and reliably coupled to the arm. This then, allows a single piece of heavy equipment to be employed with any one of the implements and also allows for adjustment of the arm's length depending on the kind of implement used. Generally, the changing of an implement is a major task which is time consuming, difficult, and dangerous. The known arrangements are particularly a frustration for smaller pieces of heavy equipment which frequently have to change tasks during a single operating shift.

SUMMARY OF THE INVENTION

It is an object of the present invention to provide a coupling assembly for securing implements to a piece of heavy equipment allowing adjustment of the arm's length depending on the kind of implement used.

It is a further object of the present invention to provide a method for quickly changing implements on heavy equipment having a boom, in order to make it more versatile.

According to one aspect of the present invention, there is provided an assembly for securing an implement, the assembly comprising a boom having a boom proximal end and a boom distal end, a link member having a link proximal end and a link distal end the link proximal end being pivotably connected to the boom proximate the boom distal end, a first recess formed in a first side of the arm, the recess being located intermediate the arm proximal end and the arm distal end, a second recess being formed in the link member proximate the link member distal end, the second recess having an elongated configuration with a longitudinal axis extending parallel to a link member longitudinal axis, an opening to the second elongated recess, the opening being at an end of the recess distant from the link member distal end, an implement assembly comprising a mounting arm and an implement, the mounting arm having a first end mounted to the implement, a pair of first pins extending outwardly from opposite sides of the mounting arm, and a pair of second pins extending outwardly from opposite sides of the mounting arm, the first pair of pins being located between an end opposite the implement receiving end and a center of gravity of the implement assembly.

In a further aspect of the present invention, there is provided a method for securing an implement to a vehicle having a boom comprising the step of supplying an assembly for securing an implement, the assembly comprising the assembly of claim 1 further including locking means for securing at least one of the pair of pins within a respective recess, a link member having a link proximal end and a link distal end, the link proximal end being pivotably connected to the arm proximate the arm distal end, a first recess formed in a first side of the arm, the recess being located intermediate the arm proximal end and the arm distal end, a second recess being formed in the link member proximate the link member distal end, the second recess having an elongated configuration with, a longitudinal axis extending parallel to a link member longitudinal axis, an opening to the second elongated recess, the opening being at an end of the recess distant from the link member distal end, an implement assembly comprising a mounting arm, the mounting arm having a mounting arm distal end mounted to an implement a pair of first pins extending outwardly from opposite sides of the mounting arm, and a second set of pins extending outwardly from opposite sides of the mounting arm, the first set of pins being located between an end opposite the implement receiving end and a center of gravity of the implement assembly, placing the implement assembly on a substrate, manipulating the link member such that the second set of pins enters the second oblong recess, raising the arm while maintaining the link member in a vertical position whereby the first set of pins will enter the first recess, and locking the first set of pins in position while in the first recess.

As used herein, the term "heavy equipment" is not tended to limit the type of vehicle or machine with which the present invention can be used. Rather, it is inclusive of all types of construction, demolition and loading equipment in which an implement situated at the end of a boom is utilized.

The assembly of the present invention comprises a link member and an implement assembly which includes a mounting arm. The mounting arm carries first and second sets of pins which are designed to fit into the first and second recesses of the link member.

When assembled, various means are provided for locking the mounting arm and link member in position. Such means can be either automatic or manual.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
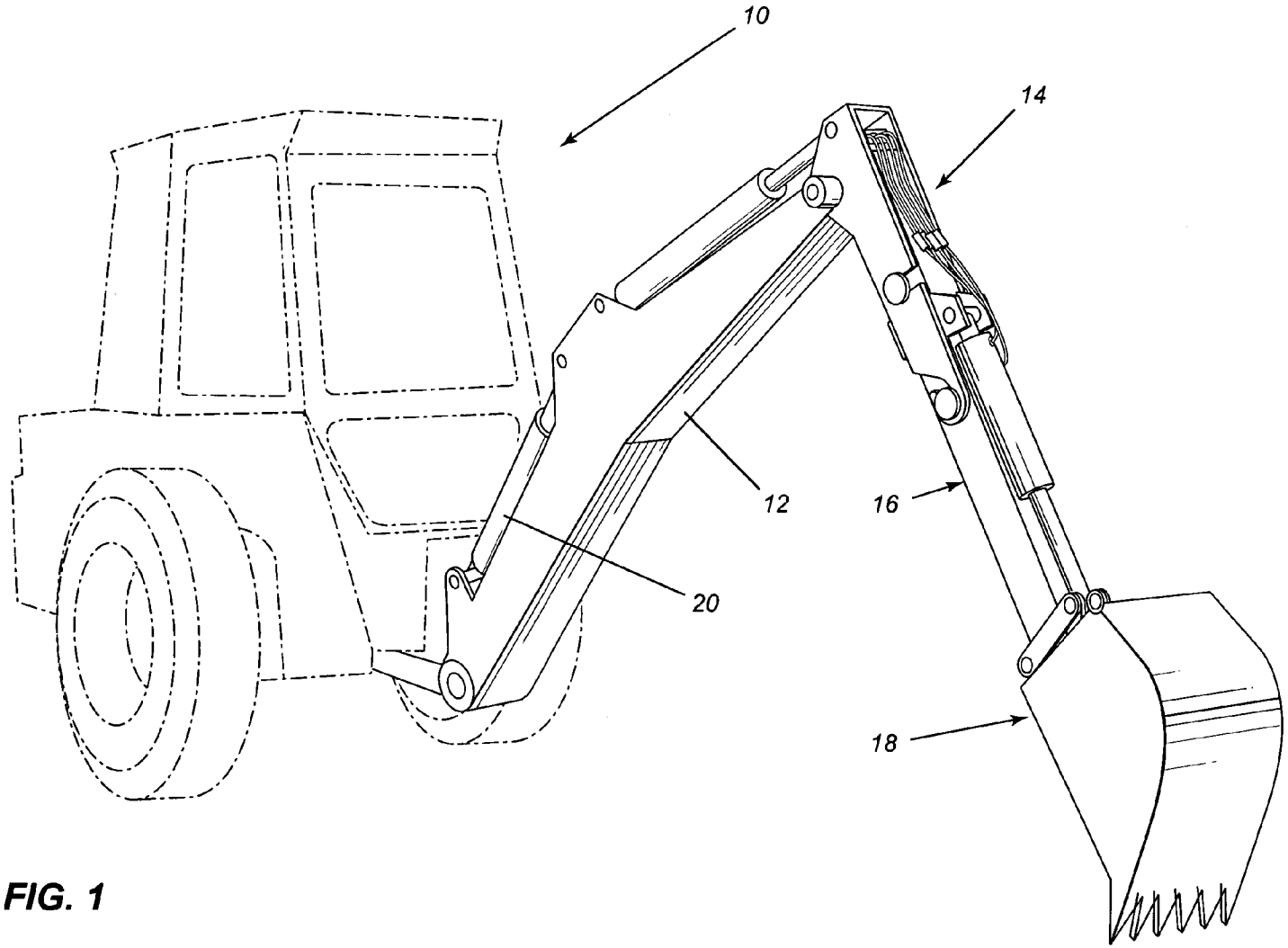
FIG. 1 is a perspective view of a piece of heavy equipment utilizing the quick connect/disconnect assembly of the present invention.

Referring to the drawings in greater detail and by reference characters thereto, there is illustrated in FIG. 1 a heavy equipment vehicle which, in the illustrated embodiment, comprises a tractor generally designated by reference numeral 10.

Tractor 10 has a boom 12 secured thereto in a conventional manner. The other major components include a link member 14, a mounting arm 16, and a shovel 18 which is one of the implements which may be used. Together, mounting arm 16 and shovel 18 constitute an implement assembly.

As is known in the art, a hydraulic cylinder 20 is utilized for raising and lowering boom 12 which is pivotably connected at its proximal end to tractor 10.

At boom distal end 22, boom 12 is connected to link member 14 at link member proximal end 24. Link member 14 is pivotably connected at boom distal end 22. A hydraulic cylinder 28 extends between a mid point on boom 12 and link member 14 at link member proximal 24.

Link member 14 includes a first U-shaped recess 30 formed at one side of link member 14. At link member distal end 26, there is provided a further U-shaped elongated recess 32 which has an entry 34 on the side of link member 14 opposed to that in which U-shaped recess 30 is formed. Mounting arm 16 of the implement assembly has a mounting arm proximal end 38 and a mounting arm distal end 40. A hydraulic cylinder is mounted on mounting arm 16 and connected to shovel 18 to permit manipulation thereof.

Mounting arm 16 also includes a first set of pins 44 extending outwardly from first and second side walls and second set of pins 46 which also extend outwardly from the side walls, but closer to said mounting arm proximal end 38.

Figure 2:
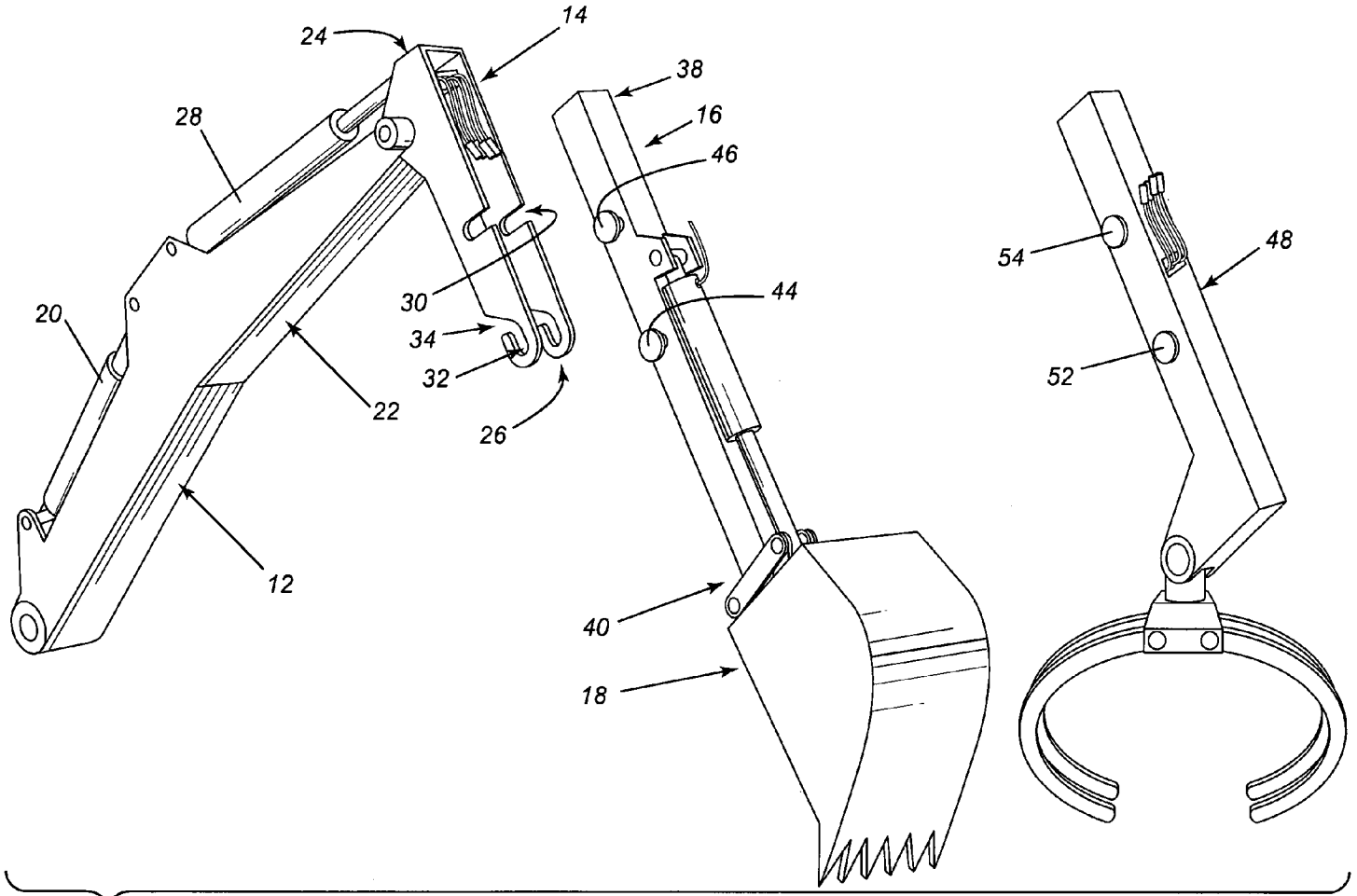
FIG. 2 is a perspective exploded view of a pair of implement assemblies which may be used with the present invention.
Figure 3A:
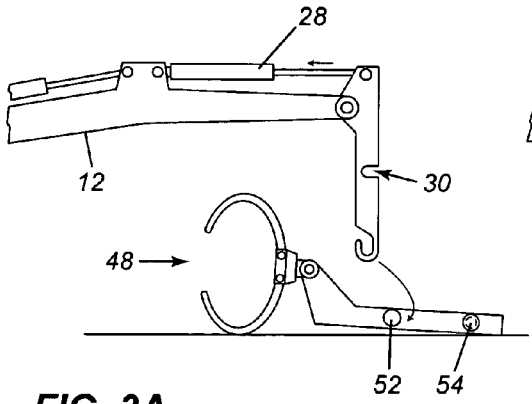
FIGS. 3A, 3B, 3C and 3D illustrate the sequence of operation for connecting the implement assembly to the link member.
Figure 3B:
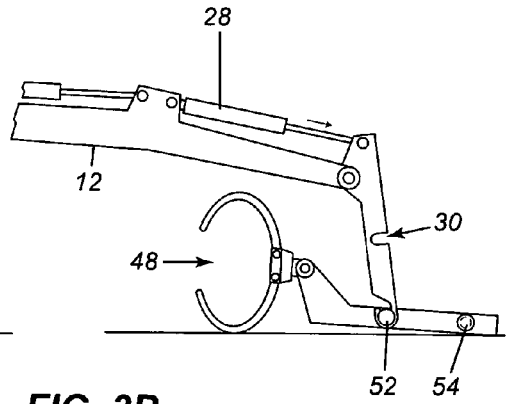
Figure 3C:
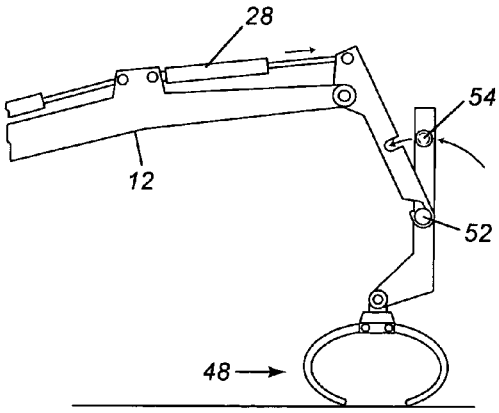
Figure 3D:
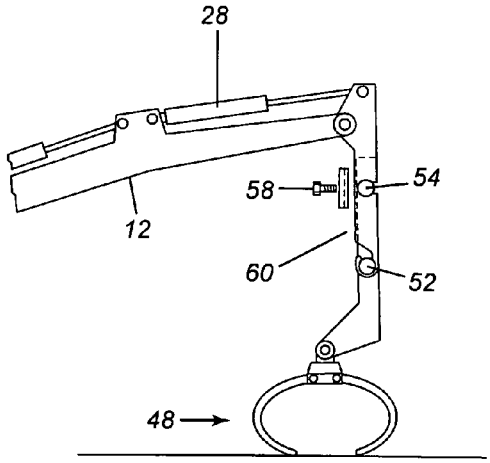
Figure 4:
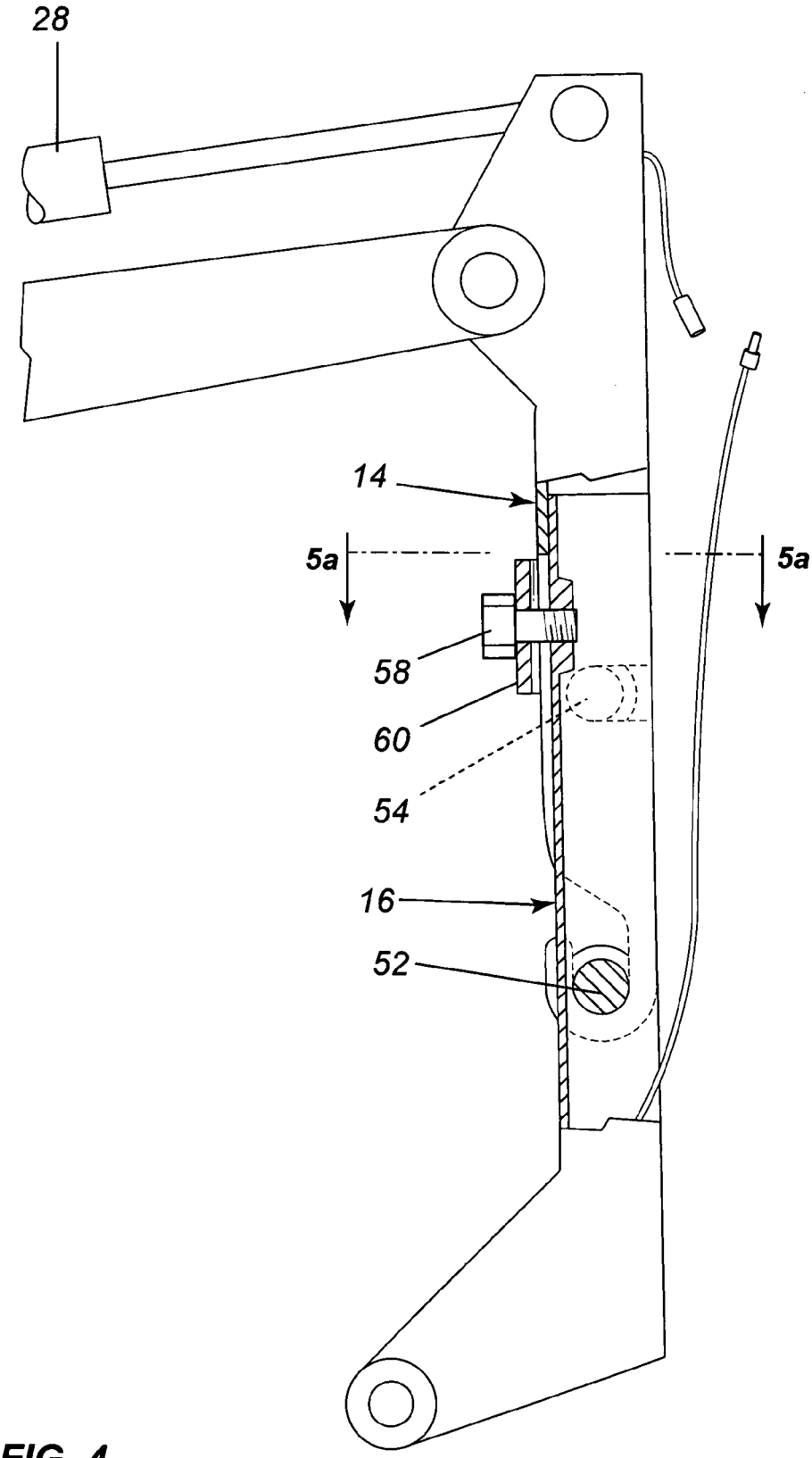
FIG. 4 is a partial cross section view illustrating locking of the implement assembly in place.

As shown in FIG. 2, a different implement comprising a grapple 48 is also provided with a mounting arm 50 of a configuration similar to mounting arm 16. Thus, there are provided a first set of pins 52 and a second set of pins 54.

Referring to FIGS. 3A to 3D, the installation procedure is illustrated. As shown by the arrows, cylinder 28 is operated so as to move link member 14 into a position whereby first set of pins 52 enter entry 34 to U-shaped recess 32. Boom 12 is then lifted to cause pins 54 to enter recess 30. Subsquently, a bolt 58 and a plate 60 may be attached to secure mounting arm 16 into position.

Figure 5A:
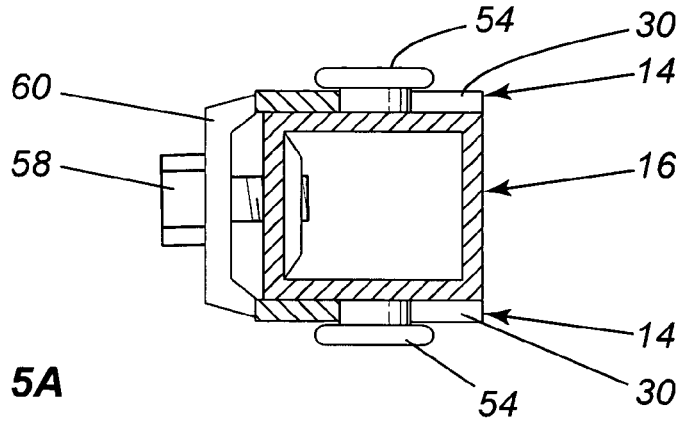
FIGS. 5A, 5B and 5C illustrate alternative locking arrangements.
Figure 5B:
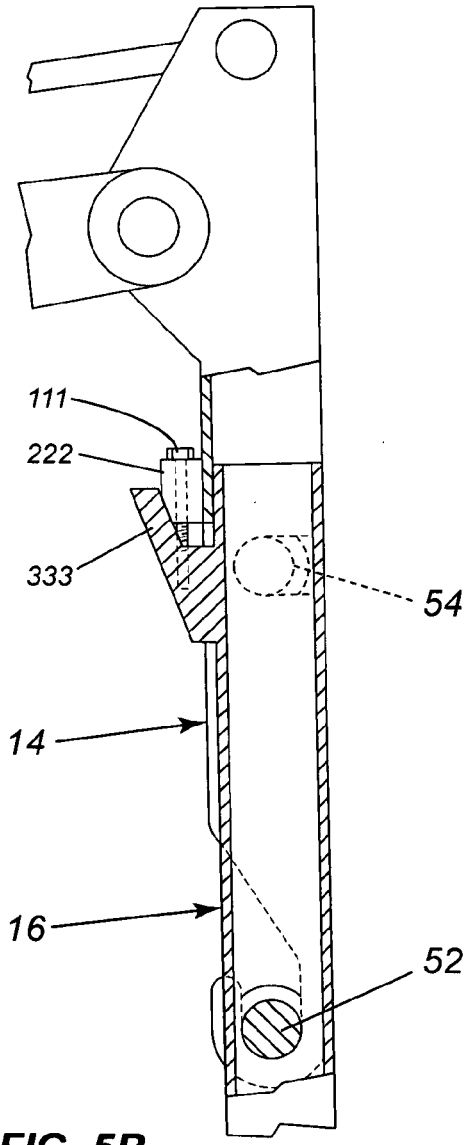
Figure 5C:
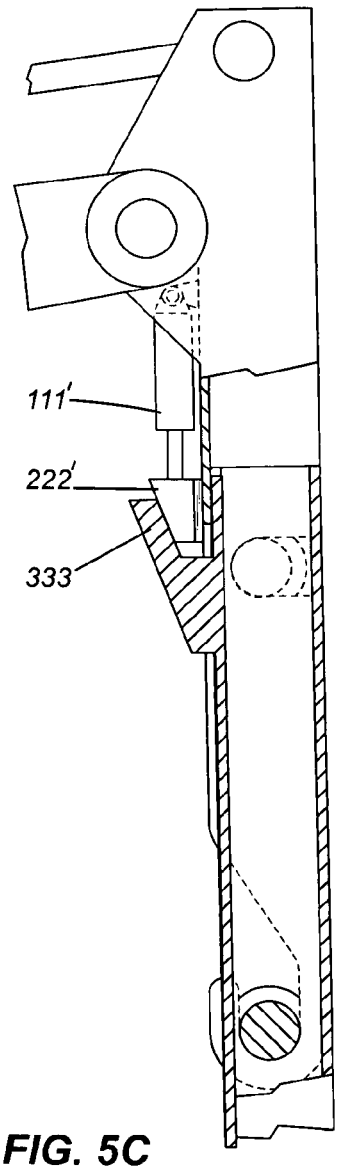

FIGS. 5A, 5B and 5C illustrate alternate means of securing link member 14 with mounting arm 16. The arrangement illustrated in FIG. 5A illustrates a bolt 58 passing through mounting arm 16 to secure the same.

In FIG. 5B, a member 333 forming a portion of mounting arm 16 extends through an opening in link member 14. A bolt 111 extends through a threaded member 222 to retain the same in position.

In FIG. 5C, a cylinder 111' is activated to place member 222' within the recess of portion 333.

It will be understood that the above described embodiments are for purposes of illustration only and that changes and modifications may be made thereto without departing from the spirit and scope of the invention.

I claim:

1. An assembly for securing an implement, said assembly comprising:

a boom having a boom proximal end and a boom distal end;

a link member having a link proximal end and a link distal end, said link proximal end being pivotably connected to said boom proximate said boom distal end;

a first set of recesses formed in first and second sides of said link member, said recesses being located intermediate said arm proximal end and said arm distal end, a second set of recesses being formed in said link member proximate said link member distal end, said second recesses each having an elongated configuration with a longitudinal axis extending parallel to a link member longitudinal axis, an opening to each of said second elongated recesses, said opening being at an end of a respective axis, said recesses being distant from said link member distal end;

an implement assembly comprising a mounting arm and an implement, said mounting arm having a first end mounted to said implement, a pair of first pins extending outwardly from opposite sides of said mounting arm, and a pair of second pins extending outwardly from opposite sides of said mounting arm, said first pair of pins being located between an end opposite said implement receiving end and a center of gravity of said implement assembly.

2. The assembly of claim 1 further including at least one cylinder extending between said boom and said link member.

3. A method for securing an implement to a vehicle having a boom comprising the step of supplying an assembly for securing an implement, said assembly comprising:

the assembly of claim 1 further including locking means for securing at least one of said pair of pins within a respective recess;

a link member having a link proximal end and a link distal end, said link proximal end being pivotably connected to said arm proximate said arm distal end;

a first recess formed in a first side of said arm, said recess being located intermediate said arm proximal end and said arm distal end, a second recess being fanned in said link member proximate said link member distal end, said second recess having an elongated configuration with a longitudinal axis extending parallel to a link member longitudinal axis, an opening to said second elongated recess, said opening being at an end of said recess distant from said link member distal end;

an implement assembly comprising a mounting arm, said mounting arm having a mounting arm distal end mounted to an implement, a pair of first pins extending outwardly from opposite sides of said mounting arm, and a second set of pins extending outwardly from opposite sides of said mounting arm, said first set of pins being located between an end opposite said implement receiving end and a center of gravity of said implement assembly;

placing said implement assembly on a substrate;

manipulating said link member such that said second set of pins enters said second oblong recess;

raising said arm while maintaining said link member in a vertical position whereby said first set of pins will enter said first recess; and locking said first set of pins in position while in said first recess.

4. The assembly of claim 1 further including means for locking said mounting arm to said link member.

5. The assembly of claim 4 wherein said means for locking comprises a bolt arrangement.

6. The assembly of claim 4 wherein said boom includes a boom hydraulic cylinder for lifting and lowering said boom.

7. The assembly of claim 4 further including a mounting arm hydraulic cylinder mounted on said mounting arm for operating an implement.

8. The assembly of claim 4 wherein said base member comprises a base wall and first and second side walls to thereby define a channel therein, said mounting arm fitting within said channel.

* * * * *